United States Patent [19]

Groothoff

[11] Patent Number: 4,819,323

[45] **Date of Patent: * Apr. 11, 1989**

[54] METHOD OF MANUFACTURING AN ELECTRO-MAGNETIC DEFLECTION UNIT FOR A CATHODE RAY TUBE

[75] Inventor: Adriaan J. Groothoff, Eindhoven, Netherlands

[73] Assignee: U.S. Philips Corporation, New York, N.Y.

[ * ] Notice: The portion of the term of this patent subsequent to Apr. 18, 2006 has been disclaimed.

[21] Appl. No.: 99,584

[22] Filed: Sep. 22, 1987

[30] Foreign Application Priority Data

Feb. 6, 1987 [NL] Netherlands ..... 8700280

[51] Int. Cl.[4] ..... H01F 7/06

[52] U.S. Cl. ..... 29/605; 242/7.03; 242/7.07; 242/118

[58] Field of Search ..... 29/605; 242/7.03, 7.07, 242/1, 118

[56] References Cited

U.S. PATENT DOCUMENTS 3,958,328 5/1976 Lee ..... 29/605

*Primary Examiner*—Carl E. Hall

*Attorney, Agent, or Firm*—F. Brice Faller

[57] ABSTRACT

An electro-magnetic deflection coil with a flangeless narrow end is wound against the inside of a funnel-shaped support 14. The support 14 opposite the windows of the coil parts 19 has recesses 25 through which axially extending guide elements 26, 27 are passed inwards during the winding process in order to support the circumferentially extending turn segments of the coil parts 19 on the rear side. After winding, each coil part 19 is formed to a coherent unit by means of a thermal treatment and the guide elements 26, 27 are removed.

3 Claims, 4 Drawing Sheets

METHOD OF MANUFACTURING AN ELECTRO-MAGNETIC DEFLECTION UNIT FOR A CATHODE RAY TUBE

BACKGROUND OF THE INVENTION

The invention relates to a method of manufacturing an electro-magnetic deflection unit for a cathode ray tub, which unit comprises a field deflection coil consisting of two saddle-shaped parts, a line deflection coil consisting of two saddle-shaped parts and an annular core of a magnetizable material surrounding the two coils to. The two parts of the field deflection coil are wound in a hollow, funnel-shaped coil support such a method is known from EP 0,102,658.

Cathode ray tubes have a neck-shaped portion one end of which accommodates an electron gun system and the other end of which continues into a cone-shaped part contiguous to a screen. An electromagnetic deflection unit surrounds the neck-shaped portion and engages the cone-shaped part or is arranged at a short distance therefrom. In the case of a colour picture tube this deflection unit must be capable of deflecting the electron beams generated by the electron gun system towards the corners of the screen while maintaining convergence. This means that both the horizontal deflection field and the vertical deflection field must have a very special distribution. To realize this, the coil support used in the known method is provided at each of its ends with an annular flange having guide grooves accurately distributed on its circumference, in which grooves the longitudinal segments of the coil turns terminate. It is then possible to control the wire distribution (and hence the field distribution).

Since in the known method the wires of the line deflection coil and those of the field deflection coil are both wound on the inside of one and the same coil support and are therefore situated close together at that area, there is a risk of ringing occurring between the line deflection coil and the field deflection coil.

Since only a limited number of grooves can be provided in the circumference of the annular flanges, it may occur—depending on the coil design—that there are a number of grooves through which turn segments of the line deflection coil and of the field deflection coil are both passed. During winding, for example the field deflection coil turns are first positioned in these grooves and thereafter the line deflection coil turns. In addition to the risk of ringing there is also the risk of breakdown between the line deflection coil and the field deflection coil.

SUMMARY OF THE INVENTION

It is an object of the invention to provide a method by which the risk of ringing or the risk of breakdown between line and field deflection coils is reduced.

After the field deflection coil parts are wound on the inside of a field coil support, a hollow, funnel-shaped line deflection coil support provided with an annular flange at its wide end and in which the two line deflection coil parts are wound is passed into the field coil support.

This enables winding the line and field deflection coils completely separately from each other while using a minimum number of components (for example 3) so that capacitive coupling is reduced.

A deflection unit which is also of the so-called yoke-winding type and which comprises field and line deflection coils wound in different supports is known per se from Japanese Patent Application No. 59-20955 laid open to public inspection. However, the method is much more cumbersome and requires a larger number of components. Each line deflection coil part is wound on a half (saddle-shaped) support and each field deflection coil part is wound on a half (saddle-shaped) support. The four half supports are subsequently assembled into one deflection unit by means of two annular core halves.

The assembly of a (funnel-shaped) line deflection coil support and a line deflection coil (provided with a wide and a narrow end) can only be passed into the field deflection coil support if the line deflection coil parts with a flangeless end are wound in the narrow end of the line deflection coil support. This means that the line deflection coil is of the incomplete saddle-type. (Deflection coils of the—classic—complete saddle-type are provided with a flange-shaped portion at both ends).

In a preferred embodiment of the method according to the invention the line deflection coil parts having a flangeless narrow end in a support are wound by unsing a line deflection coil support which has recesses located opposite to the future windows of the line deflection coil parts to be wound during the winding process for each coil part at least one axially directed guide element is passed inwards through these recesses, which element functions as a temporary support for the wire turns to be laid at the narrow end in the circumferential direction against the inside of the line deflection coil support. After completion of the winding process the turns of each line deflection coil part are formed to a coherent unit and subsequently the guide elements are removed from the line deflection coil support via the recesses.

An important aspect of the method according to the invention is the formation to a coherent unit of the turns of each line deflection coil part. This may be carried out, by using a thermoplastic-clad winding wire and by subjecting the coil parts to a thermal treatment, the so-called baking process, after winding. In the known yoke-winding method the line deflection coil parts are not "baked", because rings with grooves are used to keep the turns in position. In addition to two rings at the ends, an intermediate ring with grooves is required to give the windows of the line deflection coil parts a desired shape. Thanks to the use of a baking process for the fixation of the coil turns, the windows can be modelled in a different manner without using an intermediate ring. The line deflection coil support may have a plurality of auxiliary openings between its ends; during the winding process for each line deflection coil part radial pins are passed inwards through these auxiliary located longitudinal packets of turns, the pins being withdrawn after each line deflection coil part has been formed to a coherent unit.

In the method according to the invention a (field) deflection coil support may be used which is provided with an annular flange having radial wire guide grooves both at its wide end and at its narrow end. The field deflection coil parts are then of the complete saddle-type. If desired, the number of components can be limited when field deflection coil parts of the incomplete saddle-type are wound. (The annular flange with radial wire guide grooves for the field deflection coil turns at the narrow end can then be dispensed with). invention is that the coil support and the line deflection coil support can be secured together in a simple manner by means of a snap-connection method. Since the line and field deflection coils are separated by a separate insulator (the line deflection coil support), the insulation of the wire to be used can be dimensioned at a lower voltage.

The (field) deflection coil support may be a synthetic material body having one or more synthetic material flanges in which or around which a yoke ring of a soft magnetic material is provided. On the other hand a yoke ring itself may be the support and may be connected to a synthetic material flange at its narrow and its wide ends. Both sets of deflection coils may be either of the incomplete saddle-type, or one set (for the field deflection) may be of the complete saddle-type and one set (for the line deflection) may be of the incomplete saddle-type.

DETAILED DESCRIPTION OF THE PREFERRED EMBODIMENT

Figure 1:
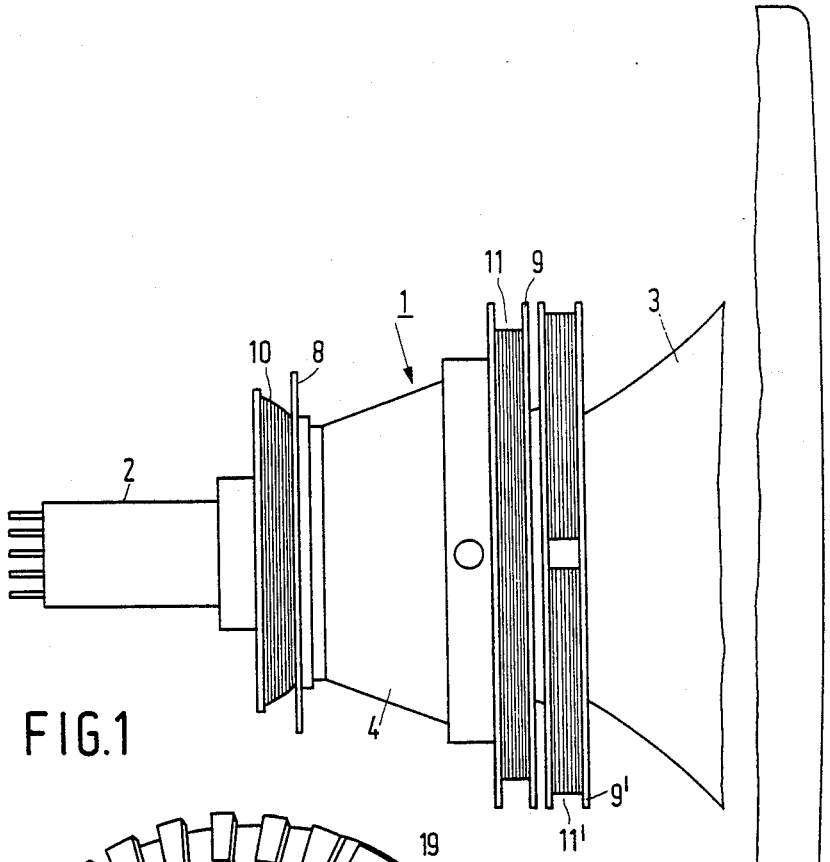
FIG. 1 is a side-elevational view of a deflection unit and positioned around the neck-shaped portion of a cathode ray tube.
Figure 2:
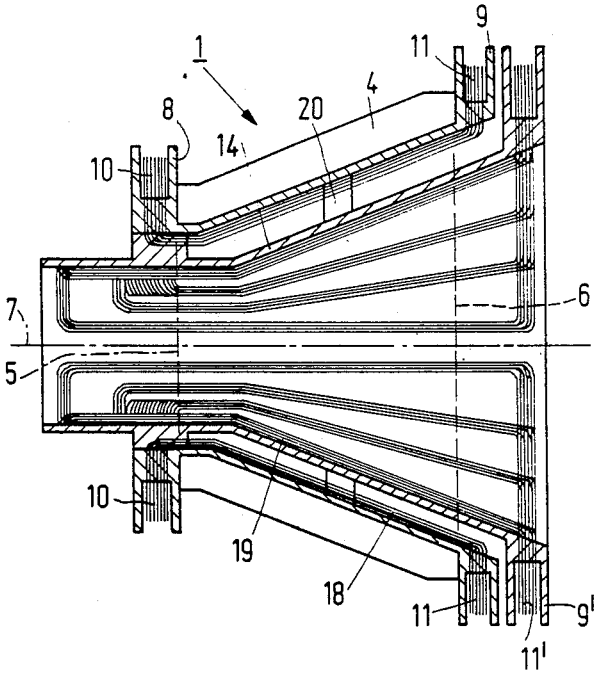
FIG. 2 is an elevational view of a longitudinal section through the deflection unit of FIG. 1.

In FIG. 1 an electro-magnetic deflection unit 1 is placed around the neck-shaped portion 2 of a cathode ray tube having a cone-shaped part of 3. Referring to FIG. 2 deflection unit 1 has a hollow, funnel-shaped support 4 with a narrow end 5 and a wide end 6 and a longitudinal axis 7. The support 4 is a yoke ring of a soft magnetic material having field flanges 8 and 9 of translucent polycarbonate on the narrow and wide ends 5 and 6, respectively. The flanges 8, 9 each have at least one tangential groove 10, 11 with a bottom and a multitude of substantially radial grooves terminating in the tangential grooves 10, 11.

A first set of deflection coils 18 for the field deflection of an electron beam in a first direction at right angles to the longitudinal axis 7 (that is to say, in the plane of the drawing) is directly wound on the inside of the support 4. The turns of the set of coils 18 each pass through the tangential grooves 10 and 11 of the flanges 8 and 9, respectively, and through radial grooves thereof. The deflection coils 18 are of the complete saddle-type. However, the invention is not limited thereto.

A second set of deflection coils 19 for the line deflection of an electron beam in a direction at right angles to the longitudinal axis 7 and at right angles to the first direction (that is to say, at right angles to the plane of the drawing) is wound in a hollow line deflection coil support 14 which is inserted with its coils in the coil support 4. The deflection coils 19 are of the incomplete saddle-type. The second set of deflection coils 19 is also wound on the inside of its support 14 and its turns also pass through a tangential groove 10′ in a flange 9′ at the wide end thereof. The first set of deflection coils 18 is wound separately, whilst an intermediate ring 20 may be present with grooves for guiding its turns. This is a means to model the (field) deflection coil window. Modelling of a coil window may alternatively be carried out in a different manner without an intermediate ring.

Figure 3:
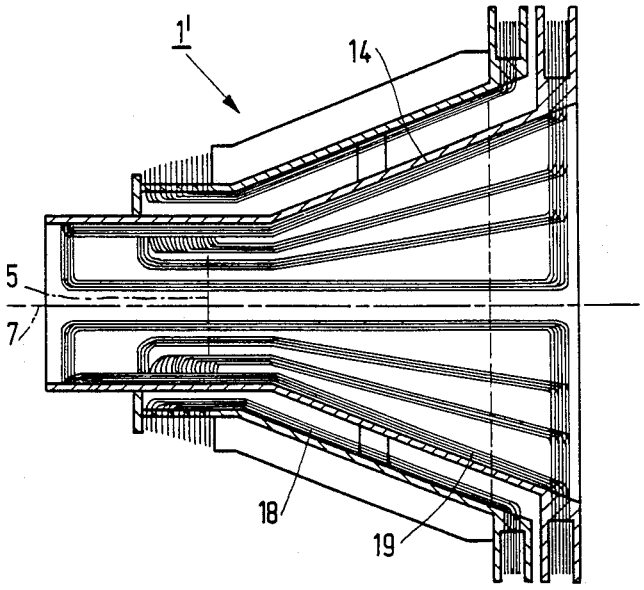
FIG. 3 is an elevational view of a longitudinal section through an alternative deflection unit.

The field deflection coils 18 of the deflection unit 1 shown in FIG. 2 are of the complete saddle-type, which means that the longitudinally varying portions located on either side of the axis 7 are connected both at the wide (front) end 6 and at the narrow (rear) end 5 by means of a packet of connection conductors arranged in a plane at right angles to the axis 7. Alternatively, one of these packets of connection conductors, namely the packet at the narrow (rear) end may be arranged in a plane parallel to the axis 7. It is then a deflection coil of the incomplete saddle-type. A deflection unit 1 having a field deflection coil 18′ of the incomplete saddle-type is shown in a cross-section in FIG. 3. An advantage of the use of such a field deflection coil is that the construction of the deflection unit may be simpler.

Figure 4:
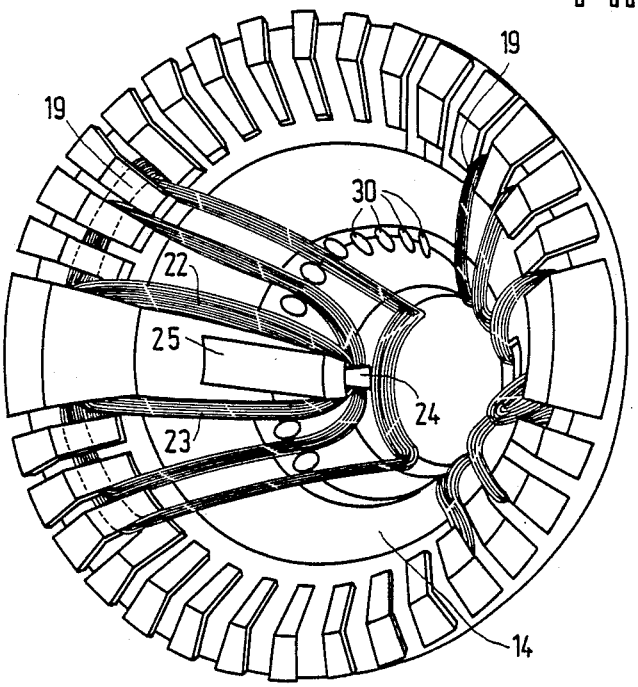
FIG. 4 is a perspective front view of a line deflection coil support with line deflection coil parts wound thereon.
Figure 5A:
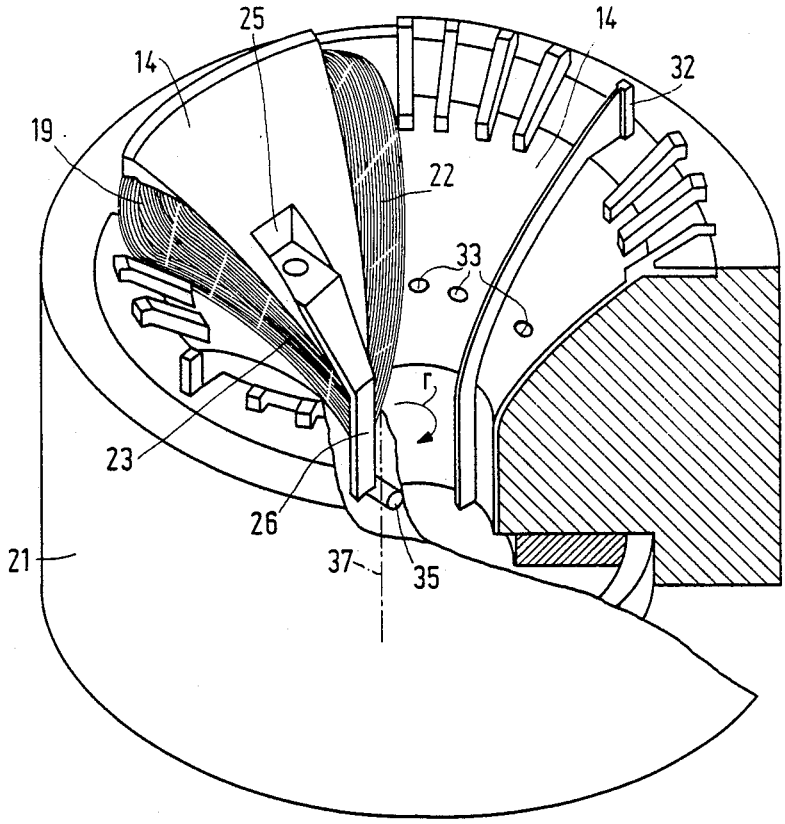
FIGS. 5*a* and 5*b* show, partly broken-up, a winding jig accommodating a line deflection coil part during successive steps of the method according to the invention.
Figure 6:
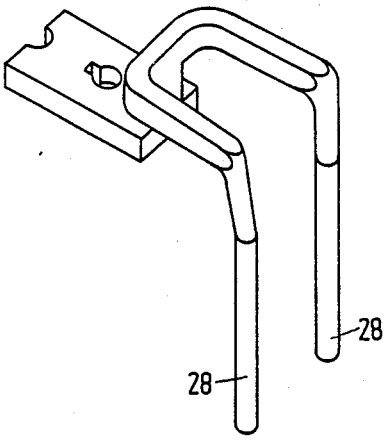
FIG. 6 shows a wire guide set used in the jig of FIG. 5.
Figure 7:
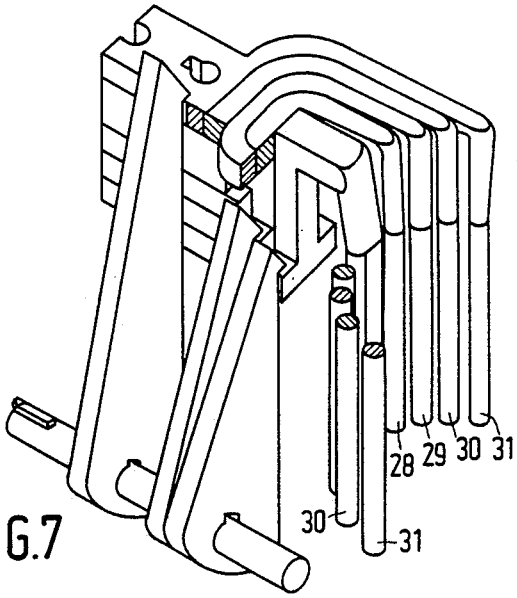
FIG. 7 shows an assembly of 5 wire guide sets which can be separately introduced into the jig of FIG. 5.

FIG. 4 is a perspective front view of the line deflection coils 19 of the deflection units 1 and 1′, respectively. The coils 19 are of the incomplete saddle-type and their longitudinal portions and their circumferentially extending rear ends are wound on the inside of the hollow, funnel-shaped support 14. The winding process is explained with reference to FIGS. 5*a* and 5*b*. A conventional type of yoke-winding machine is used, see for example DE-A 21 03 679. It can also be used for winding the field deflection coils 18 in the support 4 but with the following adaptations. A (metal) jig 21 is placed in the yoke winding machine. The (synthetic material) support 14 is accommodated in the jig 21. The arrow r denotes the direction of rotation of the jig 21 during the winding process. Firstly the inner wire packets 22, 23 of a coil half bounding the coil window are laid (FIG. 5*a*). For positioning the inner turn packets 22, 23 on the rear end, a rigid projection 24 may be formed on the support 14 (see FIG. 4). If the available space permits (in connection with the sensitivity the line deflection coil must be located as close as possible to the glass of the display tube), more projections for positioning turn packets may be present. Opposite the coil window the support 14 has a recess 25. During the winding process a metal guide element 26 may be inserted in the recess 25. Upon insertion the winding process is stopped for a moment. The guide element 26 is directed backwards axially with respect to the support 14 and functions as a support for the packet when winding a subsequent packet extending circumferentially on the rear end. The wires of this packet are passed along the rear side of the guide element 26. For supporting further circumferentially extending turn packets, further guide elements such as the guide element 27 shown in FIG. 5*b* may be successively inserted. These may be plate-shaped such as the elements 26, 27 shown in FIGS. 5*a* and 5*b* or they may be alternatively pin-shaped such as the elements 28, 29, 30, 31 shown in FIGS. 6 and 7. The use of guide elements—temporarily placed inside the support 14—provides the possibility of manufacturing the line deflection coil parts in such a manner that, after completion and mounting on a display tube, they engage the glass of this tube. To this end it is important that the turns of each line deflection coil part are formed to a coherent unit before the guide elements—following the display tube contour—are withdrawn. This is possible, for example, by giving the winding wire a thermoplastic cladding and by passing a current pulse through the coil parts (the so-called baking process) after the winding process has been completed.

Figure 5B:
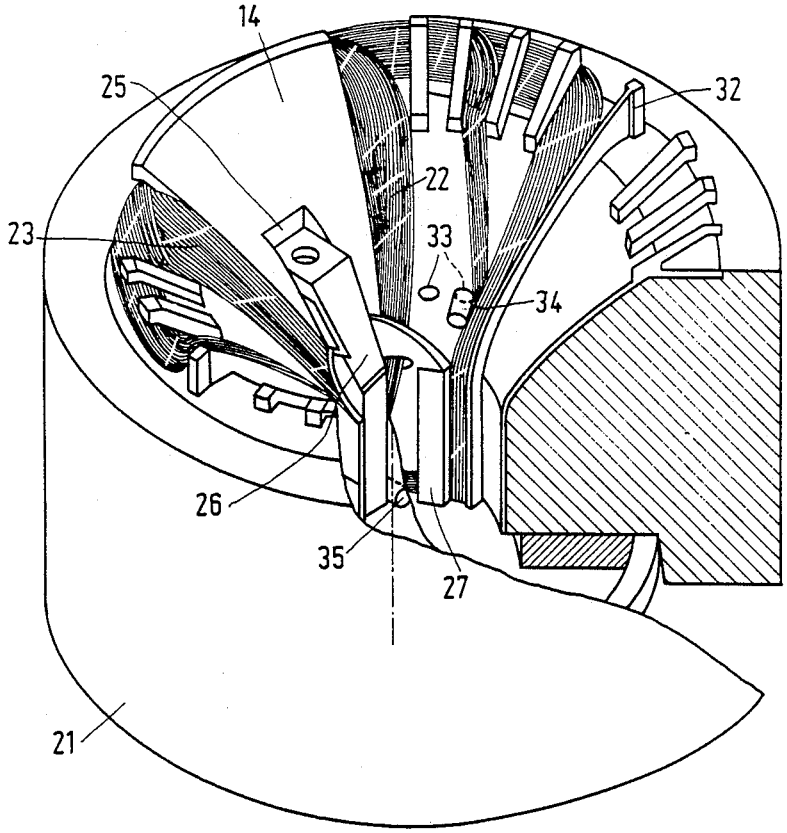

The support 14 shown in FIGS. 5*a* and 5*b* also has so-called line keys one of which (line key 32) is visible, which separate the two line deflection coil parts from each other, and it has a set of universal auxiliary openings 33. During the winding process radial pins such as pin 34 may be inserted (temporarily) through these auxiliary openings 33 so as to determine the shape of the coil windows. Where a pin is inserted the turn packet is forced to extend at an angle: the wires are drawn around the pins during winding.

A controllable wire guide 35 is directly placed under the winding jig 21 as a component of the winding machine and has for its purpose to guide the winding wire 37 at the appropriate moment behind the inserted guide elements 26, 27 etc.

After winding, the jig 21 is withdrawn from the winding machine and the coil parts are baked by means of a current pulse, whereafter the guide elements can be removed (in the embodiment shown in FIG. 7 they may be inserted one by one and all of them may be withdrawn simultaneously) and the support 14 with the coil parts wound therein can be removed from the jig 21.

What is claimed is:

1. A method of manufacturing an electro-magnetic deflection unit for a cathode ray tube, which unit comprises a field deflection coil consisting of two saddle-shaped parts, a line deflection coil consisting of two saddle-shaped parts and an annular core of a magnetizable material surrounding the two coils; such method comprising: winding the two parts of the line deflection coil on a hollow, funnel shaped line deflection coil support having an annular flange at its wide end, winding the two parts of the field deflection coil on the inside of a funnel-shaped field coil support, and then passing the line deflection coil support on which the two line deflection coil parts are wound into the field coil support.

2. A method as claimed in claim 1, characterized in that the line deflection coil support has recesses located opposite to the future windows of the line deflection coil parts to be wound and in that during the winding process for each coil part at least one axially directed guide element extends inwards through these recesses, which element functions as a temporary support for the wire turns to be laid at the narrow end in the circumferential direction against the inside of the line deflection coil support, in that after completion of the winding process the turns of each line deflection coil part are formed to a coherent unit and in that subsequently the guide elements are removed from the line deflection coil support via the recesses.

3. A method as claimed in claim 2, characterized in that the line deflection coil support further has a plurality of auxiliary openings between its ends and in that during the winding process for each line deflection coil part pins extend radially inwards through these auxiliary openings in order to determine the variation of at least two oppositely located longitudinal packets of turns, said pins being withdrawn after each line deflection coil part has been formed to a coherent unit.

* * * * *